United States Patent [19]

Schulz et al.

[11] 4,228,023

[45] Oct. 14, 1980

[54] PARAFFINIC INSULATING OILS CONTAINING A DIARYLALKANE

[75] Inventors: Johann G. D. Schulz, Pittsburgh; Anatoli Onopchenko, Monroeville; William A. Kofke, Irwin, all of Pa.

[73] Assignee: Gulf Research & Development Company, Pittsburgh, Pa.

[21] Appl. No.: 954,592

[22] Filed: Oct. 25, 1978

[51] Int. Cl.[2] ..... H01B 3/22

[52] U.S. Cl. ..... 252/63

[58] Field of Search ..... 252/63; 174/17 LF; 585/426

[56] References Cited

U.S. PATENT DOCUMENTS

| | | | |
|---|---|---|---|
| 2,653,979 | 9/1953 | Kropa et al. | 252/63 X |
| 3,036,010 | 5/1962 | Freier et al. | 252/63 |
| 4,045,507 | 8/1977 | Cupples et al. | 260/683.15 B |

FOREIGN PATENT DOCUMENTS

| | | | |
|---|---|---|---|
| 50-8100 | 1/1975 | Japan | 252/63 |
| 50-33500 | 3/1975 | Japan | 252/63 |
| 50-47195 | 4/1975 | Japan | 252/63 |
| 50-47198 | 4/1975 | Japan | 252/63 |
| 50-86699 | 7/1975 | Japan | 252/63 |
| 946540 | 1/1964 | United Kingdom | 252/63 |

*Primary Examiner*—Harris A. Pitlick

[57] ABSTRACT

Novel insulating oil compositions comprising a major amount of an insulating oil and a minor amount of a diarylalkane.

4 Claims, No Drawings

PARAFFINIC INSULATING OILS CONTAINING A DIARYLALKANE

BACKGROUND OF THE INVENTION

1. Field of the Invention

This invention relates to novel insulating oil compositions comprising a major amount of an insulating oil and a minor amount of a diarylalkane.

2. Description of the Prior Art

Insulating oils, for example, transformer oils, are required to have low power factors and high dielectric strengths, and to be able to maintain thermal and oxidative stability toward degradation and oxidation and to possess minimum tendency toward the formation of gas while in use. See, for example, U.S. Pat. No. 3,549,537 to Brewster et al. Insulating oils composed largely of naphthenes and/or highly-branched, non-cyclic, paraffins can be used satisfactorily as transformer oils, for example, but unfortunately, they possess the tendency to produce gas during service.

SUMMARY OF THE INVENTION

We have found that the gassing characteristics of insulating oils composed largely of naphthenes and/or highly-branched, noncyclic paraffins can be greatly decreased by the addition thereto of a selected amount of specific diarylalkanes.

BRIEF DESCRIPTION OF NOVEL INSULATING OIL COMPOSITIONS

The insulating oils used herein can be obtained from any naphthenic and/or paraffinic origin. By "naphthenic and/or paraffinic oils" we mean to include naturally-derived, or synthetic, stocks containing largely one-ring structures, such as cyclopentane and cyclohexane derivatives, two-ring structures, such as decalin and dicyclohexyl derivatives, three-, four-, and five-membered ring structures, which may be part of the same or different molecule and their mixtures, etc. The paraffinic oils are defined as being largely of highly-branched, non-cyclic, compounds. A more useful conventional definition is that developed by E. C. Lane and E. L. Garton in the "Bureau of Mines Report of Investigations No. 3279", September, 1935, and reported in "Petroleum Refining Processes" by M. M. Stephens and O. F. Spencer, 4th Edition, The Pennsylvania State University Press, University Park, Pa., 1958, page 38, in which classification is based on the gravity of the first two distillation cuts. Typical naphthenic crudes include those from Huntingdon Beach, San Joaquin, Coastal B-1, etc. Typical paraffinic crudes are the Poza Rica, Kuwait, Grand Bay/Quarantine Bay, Ordovician Crudes, etc. In addition these oils can be synthetic oils, such as those obtained as the result of the oligomerization of 1-olefins having from six to 14 carbon atoms, preferably from eight to 12 carbon atoms, such as 1-decene, mixtures of 1-decene and 1-octene, 1-dodecene, etc., as described, for example, in U.S. Pat. No. 4,045,507 to Cupples et al. Mixtures of naphthenic and paraffinic oils, including mixtures of natural and synthetic oils, can also be used, for example, in weight ratios of about 99:1 to about 1:99, preferably about 90:10 to about 10:90. In general the insulating oil used herein can be defined in accordance with the parameters set forth in Table I.

TABLE I

| | Broad Range | Preferred Range |
|---|---|---|
| Specific Gravity, 60°/60° F. (15.5°/15.5° C.) | 0.75 to 0.91 | 0.79 to 0.91 |
| Viscosity, SUS:s (ASTM D-2161) | | |
| (100° F. or 37.8° C.) | 40 to 70 | 50 to 70 |
| (210° F. or 98.9° C.) | 30 to 36.5 | 32 to 36.5 |
| Viscosity, Kin: cSt | | |
| (100° F. or 37.8° C.) | 4 to 13 | 6 to 13 |
| (210° F. or 98.9° C.) | 1.5 to 3.1 | 2 to 3.1 |
| Pour Point, (ASTM D-97) | | |
| °F. | −120 to −40 | −100 to −40 |
| °C. | −80 to −40 | −73 to −40 |
| Flash Point, (ASTM D-92) | | |
| °F. | 293 to 500 | 293 to 400 |
| °C. | 140 to 260 | 140 to 204 |
| Weight Percent Total Paraffin* Content | 80 to 100 | 90 to 100 |
| Weight Percent Aromatic Content | 0 to 20 | 0 to 10 |
| Interfacial Tension, mN/m, (ASTM D-971) | 40 to 80 | 40 to 60 |

Highly-branched, non-cyclic paraffins, highly-branched cyclic paraffins and/or their mixtures.

The diarylalkane that is added to the above insulating oils to reduce their gassing tendencies of such insulating oils can be defined by reference to the following structural formula:

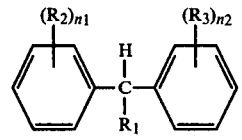

wherein $R_1$ can be hydrogen or an alkyl group having from one to 12 carbon atoms, preferably from one to eight carbon atoms, such as methyl, ethyl, propyl, n-heptyl, dodecyl, etc.; $R_2$ and $R_3$, the same or different, can be an alkyl group having from one to six carbon atoms, preferably from one to three carbon atoms, such as methyl, ethyl, propyl, n-hexyl, etc.; and n is an integer, the same or different, from 0 to 5, preferably 1 to 2. Examples of diarylalkanes that can be used are di(4-methylphenyl) methane, 4-methylphenyl-2-methylphenyl methane, 1,1-di(4-methylphenyl)ethane, 1,1-di(3,4-dimethylphenyl)ethane, 1,1-di(3,4-dimethylpheny)heptane, 1,1-di(3,4-dimethylphenyl)decane, 1-(4-methylphenyl)-1-(phenyl)hexane, 1-(3,4-diethylphenyl)-1-(4-methylphenyl)ethane, 1,1-di(3,4-diethylphenyl)ethane, etc. Preferred diarylalkanes are the 1,1-diarylalkanes, 1,1-di(4-methylphenyl)ethane and 1,1-di (3,4-dimethylphenyl)ethane. The above diarylalkanes can be used alone or as mixtures. Additionally, a hydrocarbon stream containing one or more of the diarylalkanes identified above can also be added to insulating oils to obtain the desired beneficial results.

The amounts of diarylalkane added to the insulating oil to inhibit the gassing tendency thereof can be varied over a wide limit, but, in general, the amount present, based on the weight of the final insulating composition, will be in the range of about five to about 20 weight percent, preferably about five to about 15 weight percent. Since the insulating oil and the diarylalkane are both hydrocarbons and therefore completely miscible one in the other, mixing of the two at ambient temperature and ambient pressure until a homogeneous solution is obtained will suffice.

DESCRIPTION OF PREFERRED EMBODIMENTS

The following Table II compares the properties of the naphthenic base oil employed herein with the ASTM D-3487 insulating oil specifications for Type I Oil. The naturally-derived base oil (naphthenic) was obtained from Interprovincial Pipeline No. 1 and was a mixture of low sulfur, low pour point crudes. After conventional distillation, the fraction consisting of a 50:50 mixture of light vacuum and heavy vacuum oils (Gravity °API 25) was subjected to hydrotreating following the conditions in U.S. Pat. No. 3,764,518. The purpose of this treatment was to upgrade the product through hydrocracking, isomerization and saturation. After the first stage hydrotreatment, the product was then subjected to a second stage hydrotreatment following the conditions in Canadian Pat. No. 978,881, wherein the primary purpose of such treatment is to saturate aromatic structures with hydrogen. The product from the two stage hydrotreatment has the properties shown in Table II. The synthetic base oil was prepared in accordance with the procedure of Example 1 of U.S. Pat. No. 4,045,507 of Cupples et al, employing 1-decene as feedstock. The product from this oligomerization, after stripping off unreacted 1-decene, indicated 53 percent conversion, and was found to contain 24 weight percent dimer, the remainder being the trimer, tetramer and pentamer of 1-decene. The total product was then passed over a commercial nickel catalyst (NiO104T, ⅛-inch pellets having a surface area of 125 square meters per gram) at 165° C. and 600 pounds per square inch guage (41 kilograms per square centimeter) of hydrogen pressure at a rate sufficient of effect stabilization of the product through hydrogenation. Distillation under vacuum afforded the synthetic base oil used herein, a dimer fraction boiling in the temperature range of 160°–168° C. at five millimeters of mercury.

TABLE II

| Description or Test | Naturally-derived Base Oil (Naphthenic) | Synthetic Base Oil (Paraffinic) | ASTM D-3487, Insulating Oil Specifications Type I Oil |
|---|---|---|---|
| Gravity: °API (ASTM D-1298) | 34 | 46.5 | — |
| Specific Gravity, (ASTM-D941) 60°/60° F. (15.5°/15.5° C.) | 0.8550 | 0.7949 | max 0.91 |
| Viscosity, SUV: s (ASTM D-2161) | | | |
| 37.8° C. (100° F.) | 59.5 | 42.6 | max 70 |
| 98.9° C. (210° F.) | 34.7 | 31.6 | max 36.5 |
| Viscosity, Kin: cSt | | | |
| 37.8° C. (100° F.) | 10.17 | 5.06 | max 13.0 |
| 98.9° C. (210° F.) | 2.55 | 1.65 | max 3.1 |
| Interfacial Tension: mN/M (ASTM D-971) | 55 | 50 | min 40 |
| Flash, COC: °F. (°C.) (ASTM D-92) | 350 (177) | 315 (157) | min 293 (145) |
| Fire, COC: °F. (°C.) (ASTM D-92) | 370 (188) | 345 (174) | — |
| Pour Point: °F. (°C.) (ASTM D-97) | −55(−48) | below −100 (−73) | max −40 (−40) |
| Appearance (Visual) | bright | water white | clear & bright |
| Color, (ASTM D-1500) | L 0.5 | L 0.5 | max 0.5 |
| Corrosive Sulfur, (ASTM D-1275) | Non-corrosive | Non-corrosive | Non-corrosive |
| Water PPM (ASTM D-1315) | 24 | 15 | max 35 |
| Neutralization No., (ASTM D-974) Total Acid No. | <0.03 | <0.03 | max 0.03 |
| Aniline Point, (ASTM D-611): °F. (°C.) | 204 (95) | 215 (102) | 145–172 (63–78) |
| Power Factor, (ASTM D-924): Percent | | | |
| 25° C. (77° F.) | 0.002 | 0.002 | max 0.05 |
| 100° C. (212° F.) | 0.065 | 0.05 | max 0.30 |
| Dielectric Strength: Kv (ASTM D-877) | 47 | 46 | min 30 |
| Oxidation Test, (ASTM D-2440) (0.075 Percent DBPC*) | | | |
| 72 Hour | | | |
| Sludge: Percent | 0.008 | 0.001 | max 0.15 |
| Total Acid No. | 0.10 | 0.06 | max 0.5 |
| 164 Hour | | | |
| Sludge: Percent | 0.009 | 0.003 | max 0.3 |
| Total Acid No. | 0.10 | 0.10 | max 0.6 |
| Rotary Bomb Oxidation: Min (0.075 Percent DBPC) | | | |

TABLE II-continued

| Description or Test | Naturally-derived Base Oil (Naphthenic) | | Synthetic Base Oil (Paraffinic) | ASTM D-3487, Insulating Oil Specifications Type I Oil |
|---|---|---|---|---|
| (ASTM D-2112), 140° C. | 125 | | 480+ | — |
| Analysis, Weight Percent | | | | |
| Aromatics | 0.4 | | 0.0 | |
| Saturates | 99.6 | | 100 Percent Branched Isoparaffins | |
| Mass Spec Analysis, Weight Percent | Alkanes | 24.0 | Average Mol. Weight = 280 | |
| | 1-Ring Cycloalkanes | 27.3 | | |
| | 2-Ring Cycloalkanes | 18.7 | | |
| | 3-Ring Cycloalkanes | 13.7 | | |
| | 4-Ring Cycloalkanes | 12.0 | | |
| | 5-Ring Cycloalkanes | 4.2 | | |
| | Aromatics | 0.1 | | |
| Gassing Tendency; (ASTM D-2300), $mm^3$/min Procedure B, 80° C. 50 Minutes Using Hydrogen as Saturant Gas | +38.5 | | +32.0 | — |

*2,6-ditertiarybutyl-p-cresol

Three blends were prepared for testing, one containing 11 weight percent, based on the final product, of 1,1-di(3,4-di- methylphenyl)ethane (DXE) [Blend No. 1], the second containing 13 weight percent, based on the final product, of DXE [Blend No. 2], and the third containing 12½ weight percent, based on the final product of DXE [Blend No. 3]. The remainder in each blend was naphthenic-base oil in Table II. The incorporation of DXE in the naphthenic-base oil was easily effected by physical blending. The results obtained are tabulated below in Table III.

TABLE III

| Description or Test | Blend No. 1 | Blend No. 2 | Blend No. 3 |
|---|---|---|---|
| Gravity: °API (ASTM D-1298) | | | 31.5 |
| Specific Gravity, 60°/60° F. (15.5°/15.5° C.) (ASTM D-941) | | | 0.8681 |
| Viscosity, SUV: s (ASTM D-2161) | | | |
| 37.8° C. (100° F.) | | | 58.4 |
| 98.9° C. (210° F.) | | | 34.5 |
| Viscosity, Kin: cSt | | | |
| 37.8° C. (100° F.) | | | 9.85 |
| 98.9° C. (210° F.) | | | 2.50 |
| Flash, COC: °F. (°C.) (ASTM D-92) | | | 325 (163) |
| Fire, COC: °F. (°C.) (ASTM D-92) | | | 370 (188) |
| Pour Point: °F. (°C.) (ASTM D-97) | | | below −65 (−54) |
| Appearance (Visual) | | | bright |
| Corrosive Sulfur (ASTM D-1275) | | | Non-corrosive |
| Water: ppm (ASTM D-1315) | | | 48 |
| Neutralization No. (ASTM D-974) | | | |
| Total Acid No. | | | <0.03 |
| Aniline Point (ASTM D-611) °F. (°C.) | | | 182 (83.5) |
| Power Factor (ASTM D-924): | | | |

TABLE III-continued

| Description or Test | Blend No. 1 | Blend No. 2 | Blend No. 3 |
|---|---|---|---|
| Percent | | | |
| 25° C. (77° F.) | | | 0.002 |
| 100° C. (212° F.) | | | 0.065 |
| Dielectric Strength: kV (ASTM D-877) | | | 44 |
| Oxidation Test (ASTM D-2440) (0.30 Percent DBPC*) | | | |
| 72 Hour | | | |
| Sludge: Percent | 0.001 | 0.002 | 0.001 |
| Total Acid No. | 0.05 | 0.05 | 0.11 |
| 164 Hour | | | |
| Sludge: Percent | 0.012 | 0.008 | 0.002 |
| Total Acid No. | 0.11 | 0.11 | 0.11 |
| Rotary Bomb Oxidation: Min (0.3 Percent DBPC*) (ASTM D-2112), 140° C. | | | 300 °+ |
| Analysis, HPLC: Weight Percent | | | |
| Aromatics | | | 14.4 |
| Saturates | | | 85.6 |
| Gassing Tendency: $mm^3$/min Procedure B, 80° C. 50 minutes (ASTM D-2300) Using Hydrogen as Saturant Gas | +5.1 | −2.8 | −7.5 |

*2,6-ditertiarybutyl-p-cresol

Since the primary criteria for the transformer fluids reside in having excellent oxidation stability and low gassing tendencies, each of Blends Nos. 1 and 2 were tested for these properties and found to be acceptable. Thereafter, Blend No. 3 was tested for the same properties and was also found to be acceptable. Blend No. 3 was further tested for other properties and found to be compatible for the required specifications for transformer fluids.

The data in the above table clearly show the advantages resulting from the claimed invention. The base oil alone had a tendency to give off much gas. The mere addition of DXE to the base oil in fact not only greatly reducted gassing tendency of the oil but resulted in a blend having gas absorption properties. Note, too, the particularly surprising fact that the addition of inherently unstable additive to a base oil did not adversely affect the sludge and acid number and that the number of minutes when such blends were subjected to the rotary bomb oxidation tests was actually extended from 125 to above 300. This is most unusual in light of the data in Table IV, below, which shows that DXE alone, 1,1-di(4-methylphenyl)ethane[DTE] alone or 1,1-di(4-methylphenyl)heptane[DTH] alone gave poor results when subjected to the Oxidation Test ASTM D-2440 and Rotary Bomb Oxidation Test ASTM D-2112. Other data in Table III show that a combination of base oil and DXE not only gives good oxidative stability and low gassing tendencies, but that components in the mixture are compatible with each other as physical properties show.

TABLE IV

| Description or Test | DXE | DTE | DTH |
|---|---|---|---|
| Specific Gravity (ASTM D-941) 60°/60° F. (15.5°/5° C.) | 0.9790 | 0.9752 | 0.933 |
| Boiling Point, °C. | 315–317 | 298–300 | 330–350 |
| Molecular Weight (m/e) | 238 | 210 | 280 |
| Viscosity, Kin: cSt (ASTM D-2161) | | | |
| 100° F. (37.8° C.) | 12.45 | 3.88 | 13.54 |
| 210° F. (98.9° C.) | 2.43 | 1.32 | 2.54 |
| Flash Point COC: °F. (°C.) (ASTM D-92) | 325 (163) | 327 (164) | — |
| Fire Point, °F. (°C.) (ASTM D-92) | 380 193) | — | — |
| Pour Point: °F. (°C.) (ASTM D-97) | −30 (−34) | −70 (−57) | −65 (−54) |
| Refractive index, $n_D^{20}$ | 1.5637 | 1.5608 | — |
| Interfacial Tension, mN/m (ASTM D-971) | 37 | — | — |
| Color, ASTM D-1500 | L 0.05 | — | — |
| Water: ppm (ASTM D-1315) | 29 | — | — |
| Neutralization No., (ASTM D-974) Total Acid No. | <0.03 | — | — |
| Aniline Point, °F. (ASTM D-611) (°C.) | 29 (−1.6) | — | — |
| Dielectric Constant, (ASTM D-924) | 2.5 | 2.5 | — |
| Dielectric Strength, kV: (ASTM D-877) | 46 | — | — |
| Power Factor, Percent: (ASTM D-924) | | | |
| 77° F. (25° C.) | 0.005 | 0.006 | — |
| 212° F. (100° C.) | 0.27 | 0.20 | — |
| Rotary Bomb Oxidation, min (ASTM D-2112), 140° C., (0.29 Percent DBPC) | 105 | 118 | — |
| Oxidation Test, (ASTM D-2440) 72 Hour | (0.075 Percent DBPC*) | (0.29 Percent DBPC*) | |
| Sludge: Percent | 0.84 | Nil | — |
| Total Acid No. | 9.08 | 0.47 | — |
| 164 Hour | | | |
| Sludge: Percent | 1.14 | 0.42 | — |
| Total Acid No. | 11.40 | 7.88 | — |
| Gassing Tendency: $mm^3$/min Procedure, B, 80° C. 50 min (ASTM D-2300) Using Hydrogen as Saturant Gas | −105 | — | — |

*2,6-ditertiarybutyl-p-cresol

Additional tests were carried out wherein DXE added to the naphthenic oil was also added to the synthetic oil defined above. For this purpose three blends were prepared, Blend. No. 4 containing eight weight percent DXE, Blend No. 5 containing 11 weight percent DXE and Blend No. 6 containing 10 weight percent DXE. The results obtained are set forth in Table V below.

TABLE V

| Description or Test | Blend No. 4 | Blend No. 5 | Blend No. 6 |
|---|---|---|---|
| Gravity: °API (ASTM D-1298) | — | — | 42.2 |
| Specific Gravity, 60°/60° F. (15.5°/15.5° C.) (ASTM D-941) | — | — | 0.8146 |
| Viscosity, SUV: s (ASTM D-2161) | | | |
| 37.8° C. (100° F.) | — | — | 43.7 |
| 98.9° C. (210° F.) | — | — | — |
| Viscosity, Kin: cSt | | | |
| 37.8° C. (100° F.) | — | — | 5.41 |
| 98.9° C. (210° F.) | — | — | 1.71 |
| Interfacial Tension: mN/m (ASTM D-971) | — | — | — |
| Flash, COC: °F.) (°C.) (ASTM D-92) | — | — | 315 (157) |
| Fire, COC: °F. (°C.) (ASTM D-92) | — | — | 360 (182) |

TABLE V-continued

| Description or Test | Blend No. 4 | Blend No. 5 | Blend No. 6 |
|---|---|---|---|
| Pour Point: °F. (°C.) (ASTM D-97) | — | — | below −65 (−54) |
| Apperance (Visual) | — | — | water white |
| Corrosive sulfur (ASTM D-1275) | — | — | non-corrosive |
| Water: ppm (ASTM D-1315) | — | — | 49 |
| Neutralization No. (ASTM D-974) | | | |
| Total Acid No. | — | — | <0.03 |
| Aniline Point, (ASTM D-611): °F. (°C.) | — | — | 198.5 (92.5) |
| Power Factor, (ASTM D-924): Percent | | | |
| 25° C. (77° F.) | — | — | 0.002 |
| 100° C. (212° F.) | — | — | 0.03 |
| Dielectric Strength: kV (ASTM D-877) | — | — | 44 |
| Oxidation Test, (ASTM D-2440) (0.30 Percent DBPC*) | | | |
| 72 Hour | | | |
| Sludge: Percent | 0.002 | 0.001 | 0.001 |
| Total Acid No. | 0.05 | 0.05 | 0.16 |
| 164 Hour | | | |
| Sludge: Percent | 0.004 | 0.004 | 0.003 |
| Total Acid No. | 0.11 | 0.09 | 0.63 |
| Rotary Bomb Oxidation: min (0.30 Percent DBPC*) (ASTM D-2112) 140° C. | — | — | 300+ |
| Gassing Tendency; $mm^3$/min Procedure B, 80° C. 50 minutes (ASTM D-2300) Using Hydrogen as Saturant Gas | +1.1 | −10.8 | −7.9 |

*2,6-ditertiarybutyl-p-cresol

The data in Table V show that a blend of DXE and a paraffinic base oil has acceptable oxidative stability, very low gassing tendency, and that the two fluids in a mixture are compatible with each other as physical properties show.

Obviously, many modifications and variations of the invention as hereinabove set forth, can be made without departing from the spirit and scope thereof, and therefore only such limitations should be imposed as are indicated in the appended claims.

We claim:

1. A novel insulating oil composition comprising a hydrocarbon insulating oil, wherein said hydrocarbon insulating oil is a paraffinic oil obtained from the oligomerization of 1-olefins having from six to 14 carbon atoms, and from about five to about 20 weight percent of a diarylalkane selected from the group consisting of 1,1-di(4-methylphenyl) ethane and 1,1-di(3,4-dimethylphenyl) ethane.

2. The composition of claim 1 wherein said insulating oil is a paraffinic oil obtained from the oligomerization of 1-olefins having from eight to 12 carbon atoms.

3. The composition of claim 1 wherein said insulating oil is a paraffinic oil obtained from the oligomerization of 1-decene.

4. The composition of claim 1 wherein the amount of said diarylalkane in the insulating oil composition is in the range of about five to about 15 weight percent.

* * * * *